US006702388B1

(12) United States Patent
Chiu

(10) Patent No.: US 6,702,388 B1
(45) Date of Patent: Mar. 9, 2004

(54) BALL CHAIR WITH A SECURING DEVICE

(76) Inventor: Ciber Chiu, No. 54-6, Chipan Lane, Lukang Chen, Changhua Hsien (TW)

( * ) Notice: Subject to any disclaimer, the term of this patent is extended or adjusted under 35 U.S.C. 154(b) by 0 days.

(21) Appl. No.: 10/453,625

(22) Filed: Jun. 4, 2003

(51) Int. Cl.[7] ..... A47C 7/02

(52) U.S. Cl. ..... 297/452.41; 297/DIG. 3; 297/440.1; 297/217.1; 5/654

(58) Field of Search ..... 297/452.41, 217.1, 297/195.11, DIG. 3, 440.1; 5/654

(56) References Cited

U.S. PATENT DOCUMENTS 3,635,528 A * 1/1972 Strom ..... 297/452.41
5,601,528 A * 2/1997 Mancarella ..... 601/45
5,690,389 A * 11/1997 Ekman et al. ..... 297/452.41
6,070,943 A * 6/2000 Guery-Strahm ..... 297/452.41
6,447,070 B1 * 9/2002 Ekman et al. ..... 297/452.41
6,461,284 B1 * 10/2002 Francavilla ..... 482/142
6,520,578 B1 * 2/2003 Jospa et al. ..... 297/217.1
D471,025 S * 3/2003 Chiu ..... D6/366
D471,371 S * 3/2003 Chiu ..... D6/366
6,616,238 B1 * 9/2003 Guery-Strahm ..... 297/452.41

FOREIGN PATENT DOCUMENTS

EP 0563820 * 3/1992

* cited by examiner

*Primary Examiner*—Laurie K. Cranmer
(74) *Attorney, Agent, or Firm*—Troxell Law Office PLLC

(57) ABSTRACT

A ball chair with a securing device has a seat (10), a ball-shaped cushion (20) and a guard rod (30). The ball-shaped cushion (20) rests on the seat (10). The seat (10) has a backrest (13) attached to a rear end of the seat (10), and the guard rod (30) is erected at a front end of the seat (10). Thus, the ball-shaped cushion (20) is firmly secured on the seat (10) to avoid danger of a user falling when sitting on the ball chair.

6 Claims, 4 Drawing Sheets

BALL CHAIR WITH A SECURING DEVICE

BACKGROUND OF THE INVENTION

1. Field of the Invention

The present invention relates to a ball chair, and more particularly to a ball chair having a securing device to hold a ball-shaped cushion on a seat in position to enhance the safety of the ball chair.

2. Description of Related Art

A conventional ball chair is composed of a chair and a ball-shaped cushion. The chair has a seat plate with a top face and a partly-spherical passage defined in the top face of the seat plate to receive a lower portion of the ball-shaped cushion inside. By placing the ball-shaped cushion in the partly-spherical passage of the chair, a ball chair is achieved. However, when a user sits in the ball chair, the ball-shaped cushion is pressed to deform forward and then falls out of the partly-spherical passage such that the user easily falls from the ball chair. Additionally, when the ball chair is bumped or vibrated, the ball-shaped cushion rebounds and easily springs out of the partly-spherical passage. Therefore, the ball chair is not safe and not stable for the user.

The present invention has arisen to mitigate or obviate the disadvantages of the conventional ball chair.

SUMMARY OF THE INVENTION

The main objective of the present invention is to provide a ball chair with a securing device that avoids a ball-shaped cushion separating from a seat to whereby the ball chair is safe and steady.

Further benefits and advantages of the present invention will become apparent after a careful reading of the detailed description with appropriate, reference to the accompanying drawings.

DETAILED DESCRIPTION OF THE PREFERRED EMBODIMENT

Figure 1:
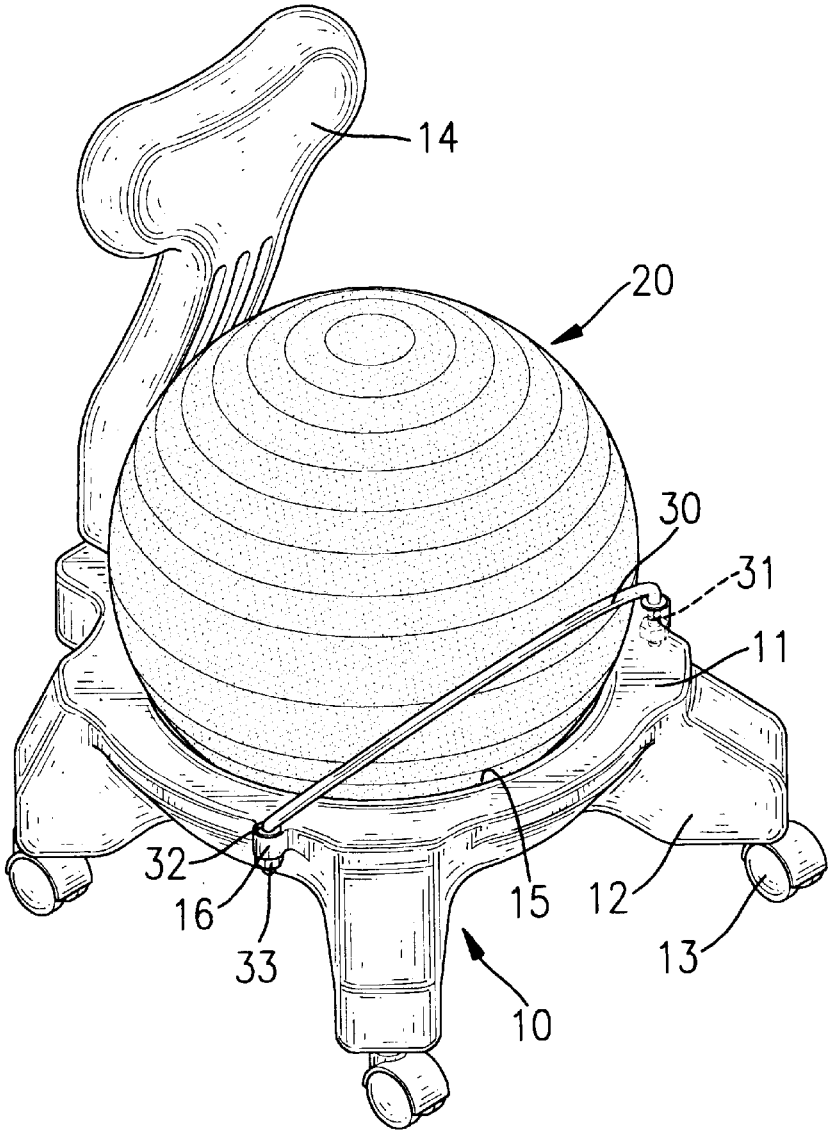
FIG. 1 is a perspective view of a ball chair with a securing device in accordance with the present invention.
Figure 2:
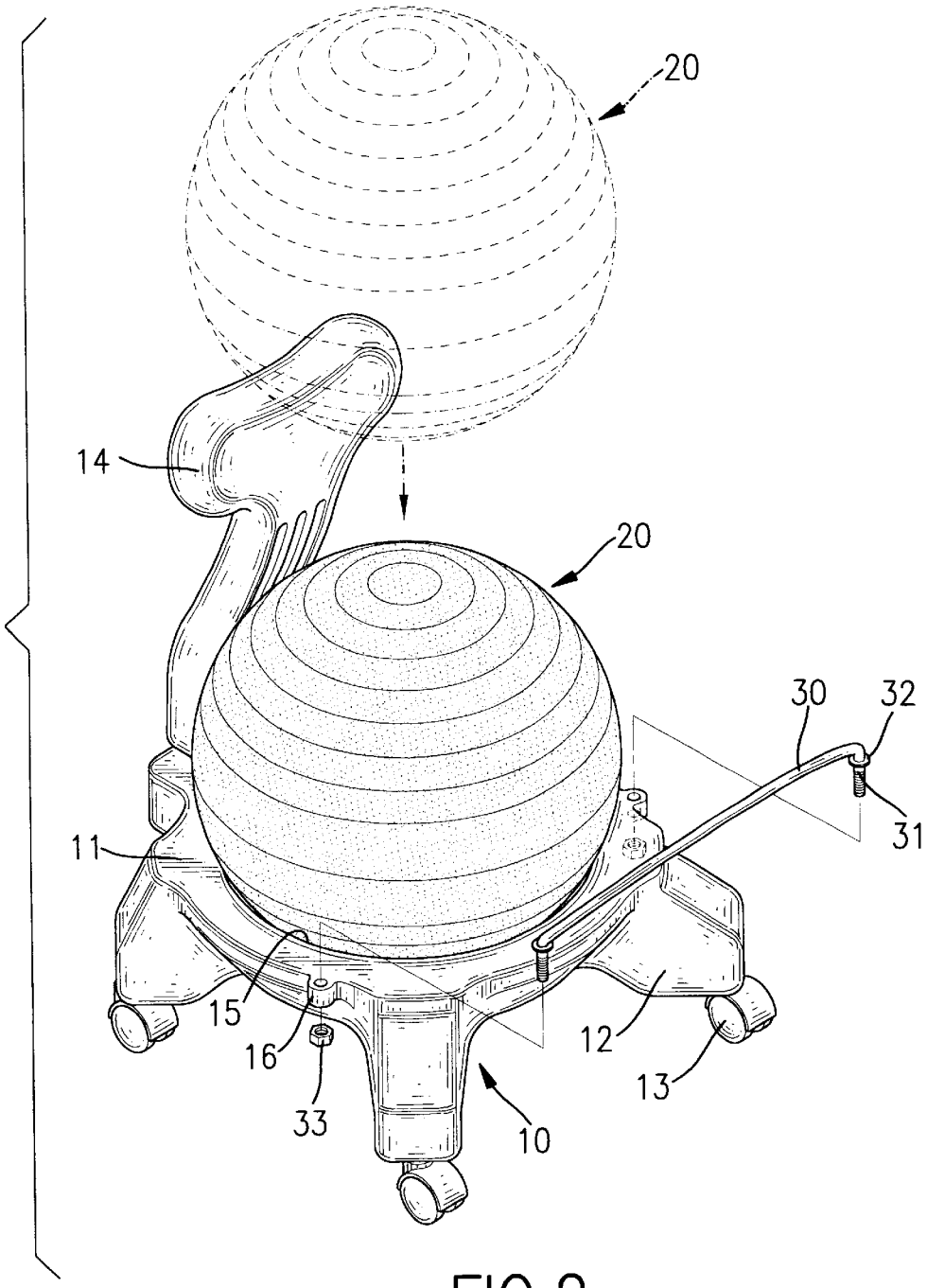
FIG. 2 is an exploded perspective view of the ball chair with a securing device in FIG. 1.
Figure 3:
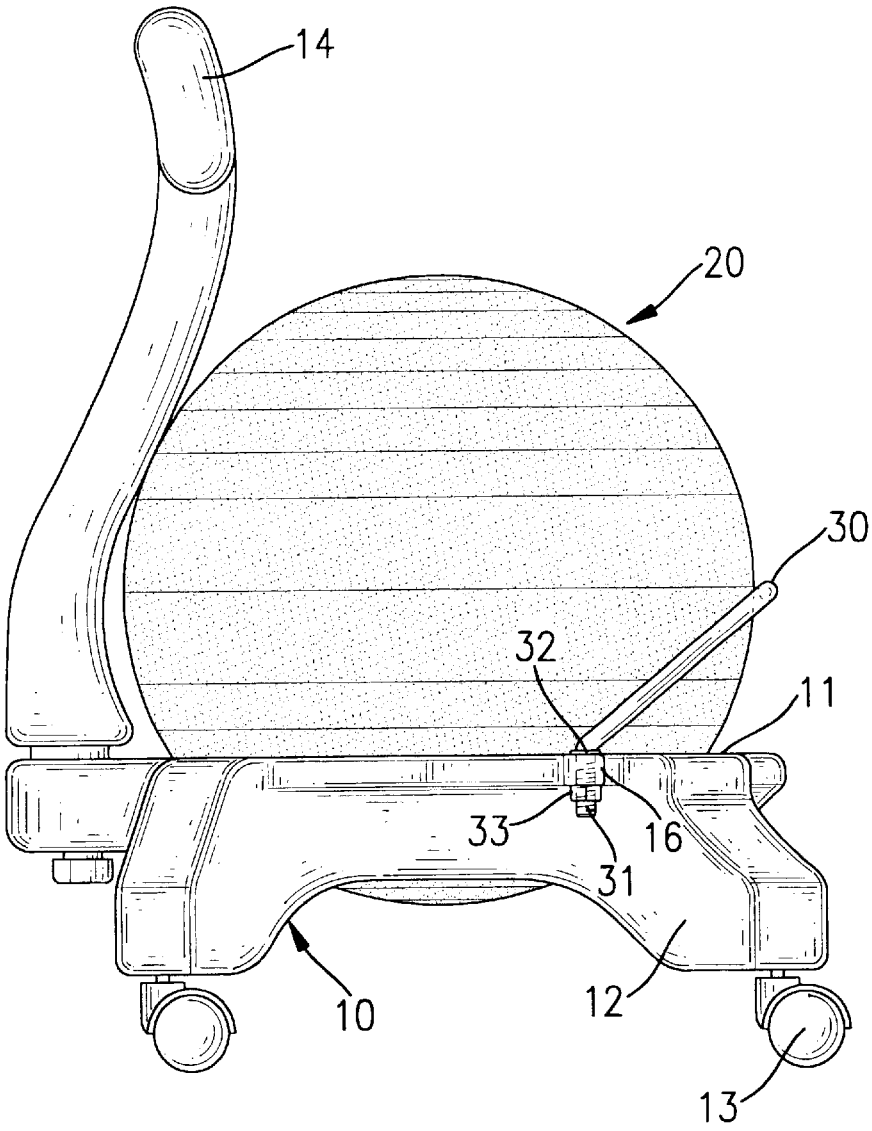
FIG. 3 is a side plan view of the ball chair with a securing device in FIG. 1.

With reference to FIGS. 1, 2 and 3, a ball chair with a securing device in accordance with the present invention comprises a seat (10), a ball-shaped cushion (20) and a securing device.

The seat (10) has a seat plate (not numbered) with a top face (11), a bottom face (not numbered), a front edge, and a rear edge, and has multiple legs (12), a dished passage (15) extending from the top face (11) to the bottom face, and a backrest (14). The multiple legs (12) are attached to the bottom face to support the seat plate and each leg (12) has a distal end and a wheel (13) attached to the distal end of each leg (12) to make the ball chair be moved easily. The backrest (14) upwardly extends from the rear edge of the seat plate to adapt to support a user's back.

The ball-shaped cushion (20) is made of resilient bladder and has a maximum diameter slightly larger than a maximum diameter of the passage (15) and a minimum diameter smaller than a minimum diameter of the passage (15), thus the ball-shaped cushion (20) rests on the seat plate such that a lower portion of the ball-shaped cushion (20) can protrude from the passage (15). Optionally, two connecting ears (16) are respectively formed on two opposite sides of the front edge of the seat plate for engaging with the securing device and each ear (16) has a through hole (162).

The securing device is attached to the front edge of the seat plate and is a guard rod (30) made of rigid material such as plastic rod, metal rod etc. The guard rod (30) has a main spar (not numbered) that is preferably curved and two end pieces somewhat perpendicular in a same direction to the main spar. Each end piece comprises a threaded end (31) with a flange (32) formed near the threaded end (31). The threaded ends (31) are respectively extended through the through holes (162) to secure the guard rod (30) to erect at the front edge of the seat (10) until the flanges (32) abut the connecting ear (16). Then, a nut (33) is mounted on the threaded end (31) to fasten the guard rod (30) on the seat (10). Thereby, the guard rod (30) holds at an upper portion in comparison with the lower portion of the ball-shaped cushion (20) in cooperation with the backrest (14) and the seat (10) to avoid the ball-shaped cushion (20) falling off from the seat (10), even when the ball chair vibrates.

Figure 4:
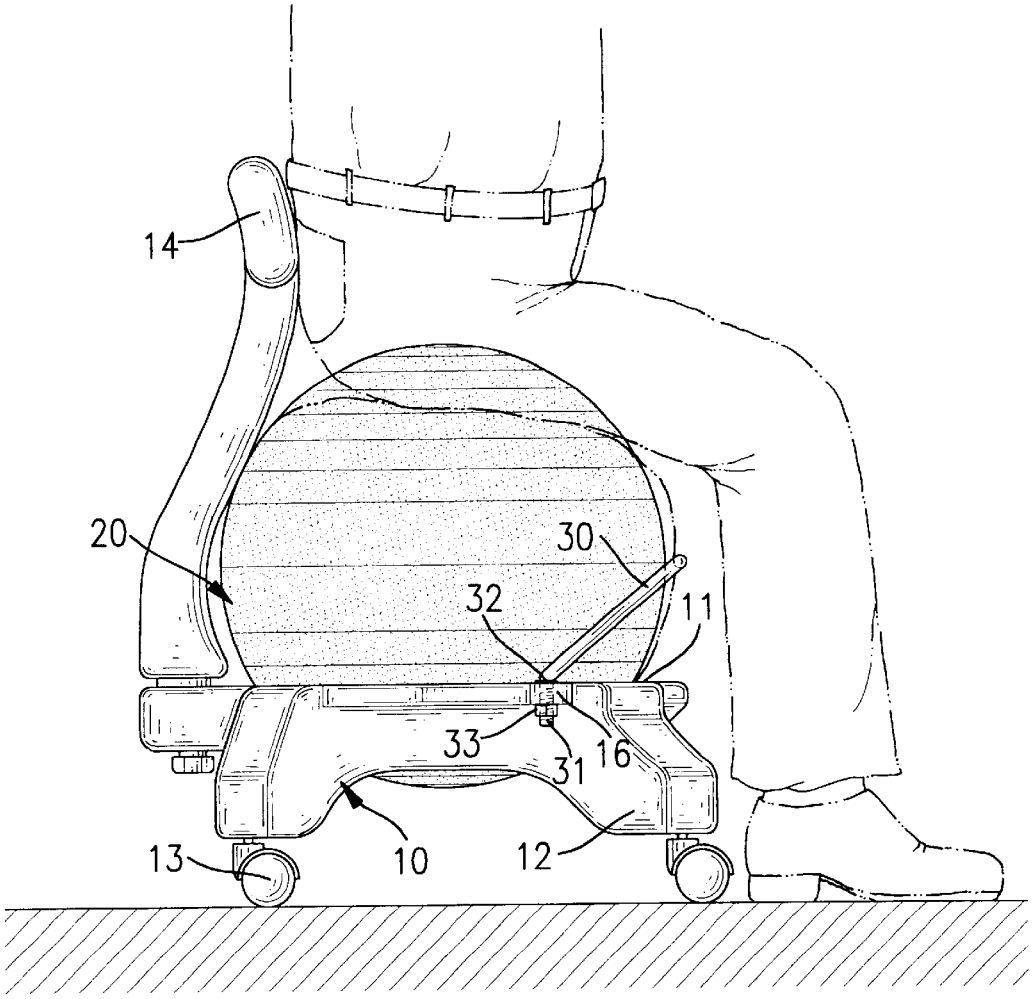
FIG. 4 is an operational side plane view of the ball chair with a securing device.

With reference to FIG. 4, when a user sits on the ball chair, the ball-shaped cushion (20) is pressed to deform and biased to the front edge of the seat (10). The guard rod (30) stops the ball-shaped cushion (20) to further deform to avoid the malpositioning of the ball-shaped cushion (20), which may otherwise cause the user fall from the ball chair. Thus, the ball chair is safe and stable.

Although the invention has been explained in relation to its preferred embodiment, it is to be understood that many other possible modifications and variations can be made without departing from the spirit and scope of the invention as hereinafter claimed.

What is claimed is:

1. A ball chair with a securing device comprising:

a seat (10) having a seat plate with a top face (11), a bottom face, a front edge, and a rear edge;

multiple legs (12) attached to the bottom face of the seat plate to support the seat plate;

a passage (15) defined in the top face (11) of the seat plate; and a backrest (14) upwardly extending from the rear edge of the seat plate;

a ball-shaped cushion (20) made of resilient bladder and partially received inside the passage (15) to rest on the seat; and a securing device composed of a guard rod (30) with two ends (31) erecting at the front edge of the seat plate to hold the ball-shaped cushion (20) with the backrest (14) and the seat plate.

2. The ball chair with a securing device as claimed in claim 1, wherein the seat plate further has two connecting ears (16) formed on two opposite sides of the front edge and each ear (16) has a through hole (162);

each end of the guard rod (30) is a threaded end (31) to insert into one of through holes (162);

a flange (32) is formed near each respective threaded end (31) to abut a corresponding one of the connecting ears (16); and a nut (33) is mounted on each respective threaded end (31) to fasten the guard rod (30) on the seat (10).

3. The ball chair with a securing device as claimed in claim 1, wherein the guard rod (30) is curved to correspond to the ball-shaped cushion (20).

4. The ball chair with a securing device as claimed in claim 3, wherein the seat plate further has two connecting ears (16) formed on two opposite sides of the front edge and each ear (16) has a through hole (162);

each end of the guard rod (30) is a threaded end (31) to insert into one of the through holes (162);

a flange (32) is formed near each respective threaded end (31) to abut a corresponding one of the connecting ears (16); and a nut (33) mounted on each respective threaded ends (31) to fasten the guard rod (30) on the seat (10).

5. The ball chair with a securing device as claimed in claim 4, wherein the passage (15) is dished with a larger diameter above a smaller diameter and configured to mate with part of a periphery of the ball-shaped cushion (20); and the ball-shaped cushion (20) has a maximum diameter larger than the larger diameter of the passage and a minimum diameter smaller than the smaller diameter of the passage (15) whereby the ball-shaped cushion (20) rests on the seat plate.

6. The ball chair with a securing device as claimed in claim 5, wherein each leg (12) has a distal end and a wheel (13) attached to a corresponding one of the distal ends of the legs (12) to enable the ball chair to be moved easily.

* * * * *